US011214975B2

(12) United States Patent
Kappe

(10) Patent No.: US 11,214,975 B2
(45) Date of Patent: Jan. 4, 2022

(54) COMPACT MULTI-TIER PARKING GARAGE AND METHOD FOR STORING VEHICLES IN SUCH A PARKING GARAGE

(71) Applicant: Kappe Intermediair B.V., Havelte (NL)

(72) Inventor: Jantinus Kappe, Havelte (NL)

(73) Assignee: Kappe Intermediair B.V., Havelte (NL)

( * ) Notice: Subject to any disclaimer, the term of this patent is extended or adjusted under 35 U.S.C. 154(b) by 170 days.

(21) Appl. No.: 16/604,678

(22) PCT Filed: Apr. 11, 2018

(86) PCT No.: PCT/NL2018/050223
§ 371 (c)(1),
(2) Date: Oct. 11, 2019

(87) PCT Pub. No.: WO2018/190710
PCT Pub. Date: Oct. 18, 2018

(65) Prior Publication Data

US 2021/0131135 A1 May 6, 2021

(30) Foreign Application Priority Data

Apr. 11, 2017 (NL) ..... 2018687

(51) Int. Cl.
*E04H 6/28* (2006.01)

(52) U.S. Cl.
CPC ..... *E04H 6/287* (2013.01)

(58) Field of Classification Search
CPC ..... E04H 6/189; E04H 6/287
See application file for complete search history.

(56) References Cited

U.S. PATENT DOCUMENTS 1,697,345 A * 1/1929 Chaudoir ..... E04H 6/282 414/263
1,919,269 A * 7/1933 Becker ..... E04H 6/24 414/256

(Continued)

FOREIGN PATENT DOCUMENTS

CN 201268972 Y 7/2009
CN 202990512 U 6/2013

(Continued)

OTHER PUBLICATIONS

Oct. 9, 2018, International Search Report and Written Opinion, PCT/NL2018/050223.

*Primary Examiner* — James M Ference
(74) *Attorney, Agent, or Firm* — Banner & Witcoff, Ltd.

(57) ABSTRACT

Compact multi-tier parking garage (1) and method for storing vehicles (6) in such a parking garage. A multi-tier parking garage for vehicles having at least one tier (3) with at least one parking space (2) for one parked vehicle, an elevator (5) having an elevator platform (7) for supporting a vehicle movable between at least two positions, vertically aligned with the tier for allowing a vehicle to be transferred from the elevator platform to the parking space of the tier and from the parking space to the elevator platform. The elevator platform is rotatable to positions aligned with an entry (24) and an exit (25) such that vehicles can enter and leave driving in a forward direction.

2 Claims, 8 Drawing Sheets

(56) References Cited

U.S. PATENT DOCUMENTS 2,598,413 A * 5/1952 Morley ..... E04H 6/287 414/240
2,647,647 A * 8/1953 Alimanestiano ..... E04H 6/186 414/254
2,650,728 A * 9/1953 Goodwyn ..... E04H 6/287 414/661
2,755,941 A * 7/1956 Orr ..... E04H 6/282 414/262
2,838,186 A * 6/1958 Alimanestiano ..... E04H 6/287 414/254
2,915,204 A * 12/1959 Alimanestiano ..... E04H 6/186 414/282
2,923,421 A * 2/1960 De Senigon De Roumefort ..... E04H 6/185 414/232
3,063,579 A * 11/1962 Alimanestiano ..... E04H 6/186 414/254
3,217,905 A * 11/1965 Frangos ..... E04H 6/245 414/239
3,301,413 A * 1/1967 Coursey ..... E04H 6/185 414/254
3,395,815 A * 8/1968 Johnson ..... E04H 6/22 414/232
3,497,087 A * 2/1970 Lawrence ..... E04H 6/287 414/252
3,499,553 A * 3/1970 Stienen ..... E04H 6/245 414/239
3,618,793 A * 11/1971 Coursey ..... E04H 6/422 414/233
3,896,955 A * 7/1975 Collins ..... E04H 6/186 414/254
3,960,282 A * 6/1976 Manaugh ..... E04H 6/186 414/260
4,039,089 A * 8/1977 Kochanneck ..... E04H 6/287 414/256
4,108,322 A * 8/1978 Kochanneck ..... E04H 6/287 414/263
4,264,257 A * 4/1981 Saurwein ..... E04H 6/287 414/253
4,265,581 A * 5/1981 Ives ..... E04H 6/287 414/228
4,768,914 A * 9/1988 Sing ..... B65G 1/0478 198/300
4,976,580 A * 12/1990 Knakrick ..... E04H 6/287 414/254
5,049,022 A * 9/1991 Wilson ..... E04H 6/186 414/253
5,116,182 A * 5/1992 Lin ..... E04H 6/186 414/254
5,173,027 A * 12/1992 Trevisani ..... E04H 6/183 414/257
5,456,562 A * 10/1995 Schlecker ..... E04H 6/186 414/254
5,478,182 A * 12/1995 Hildebrand ..... E04H 6/282 414/261
5,505,573 A * 4/1996 Han ..... E04H 6/186 414/254
5,669,753 A * 9/1997 Schween ..... E04H 6/22 414/239
5,829,941 A * 11/1998 Morfin ..... E04H 6/282 414/261
5,851,098 A * 12/1998 Buckenauer ..... E04H 6/285 414/263
5,915,907 A * 6/1999 Yatou ..... E04H 6/287 414/254
5,980,185 A * 11/1999 Vita ..... E04H 6/422 414/254
6,077,017 A * 6/2000 Durant ..... E04H 6/186 414/254
6,302,634 B1 * 10/2001 Grenader ..... E04H 6/225 414/240
6,332,743 B1 * 12/2001 Park ..... E04H 6/186 414/234
6,702,541 B1 * 3/2004 Lee ..... E04H 6/186 414/253
6,733,226 B1 * 5/2004 Bonin ..... E04H 6/245 414/253
10,472,842 B2 * 11/2019 Lee ..... E04H 6/285
2003/0035707 A1 * 2/2003 Volpe ..... E04H 6/287 414/254
2005/0095092 A1 * 5/2005 Segal ..... E04H 6/282 414/263
2006/0228196 A1 * 10/2006 Li ..... E04H 6/28 414/227
2006/0245859 A1 * 11/2006 Frank ..... E04H 6/14 414/277
2007/0128009 A1 * 6/2007 Lee ..... E04H 6/186 414/253
2010/0086385 A1 * 4/2010 Shani ..... E04H 6/22 414/232
2012/0097485 A1 * 4/2012 Stutz ..... E04H 6/285 187/249
2017/0211287 A1 * 7/2017 Schmitt ..... G07C 9/20
2017/0226764 A1 * 8/2017 Nussbaum ..... E04H 6/36
2017/0234023 A1 * 8/2017 Stokes, Sr. ..... E04H 6/185 414/253
2021/0131135 A1 * 5/2021 Kappe ..... E04H 6/186

FOREIGN PATENT DOCUMENTS

DE 4130141 A1 3/1993
DE 4338341 A1 5/1995
DE 20008728 U1 8/2000
DE 20120030 U1 3/2002
DE 10233558 A1 10/2003
EP 1255002 A1 11/2002
EP 0898033 B1 6/2003
NL 1028760 C2 10/2006
WO 8602687 A1 5/1986
WO 9116515 A1 10/1991
WO 2009059538 A1 5/2009
WO 2012023144 A1 2/2012

* cited by examiner

COMPACT MULTI-TIER PARKING GARAGE AND METHOD FOR STORING VEHICLES IN SUCH A PARKING GARAGE

CROSS-REFERENCE TO RELATED APPLICATIONS

This application is a U.S. National Stage application under 35 U.S.C. § 371 of International Application PCT/NL2018/050223 (published as WO 2018/190710 A1), filed Apr. 11, 2018, which claims the benefit of priority to Application NL 2018687, filed Apr. 11, 2017. Benefit of the filing date of these prior applications is hereby claimed. Each of these prior applications is hereby incorporated by reference in its entirety.

FIELD AND BACKGROUND OF THE INVENTION

The invention relates to a multi-tier parking garage according to the introductory portion of claim 1, to a method of using a multi-tier parking garage according to the introductory portion of claim 9 to a multi-tier parking garage according to the introductory portion of claim 10.

Such parking garages and such a method are known from U.S. Pat. No. 5,049,022. In such parking garages, vehicles without a driver or passengers are moved by mechanized means between an elevator and parking positions, which allows particularly compact storage of the vehicles. A vehicle resting on an elevator platform is handed over from an elevator to a storage cell, parking stall or a temporary parking bay for entering or getting out of a vehicle dolly or cart or vice versa. However, driving into and/or out of such systems is difficult and entering or getting out of a vehicle requires particular attention in view of the passages in the temporary parking bay.

Other parking garages with mechanized means for displacement of vehicles between the elevator and the parking positions are known from NL 1 028 760 C, CN 201268972Y, DE 201 20 030 U1, DE 200 08 728 U1 and EP 0 898 033 B1.

However, such mechanized means for displacing vehicles without rotating the wheels are complicated and in many cases require the use of a number of vehicle carriers equal to the number of vehicles the parking garage can accommodate.

SUMMARY OF THE INVENTION

It is an object of the present invention to provide a compact parking garage which is more comfortable in use and allows easy storage and collection of vehicles.

According to the invention, this object is achieved by providing a parking garage according to claim 1. The invention can also be embodied in a method according to claim 9.

Because the vehicle lifting position can be rotated from a position with and end in driving direction facing the entrance path to a position in which the same end faces the exit path, a vehicle can be driven in forward direction into the entrance path (towards the elevator) and is transferred onto the exit path in such a orientation that it can be driven out of the exit path (away from the elevator) in forward direction. This facilitates use of the parking garage for users and allows the entry and exit paths to connect to the elevator well in any direction. In particular a combined (e.g. two lane) driveway may be provided via which the parking garage can be entered and exited and therefore the entrance and exit require little ground surface area and can conveniently be adapted to meet city planning constraints, for instance if only a single combined driveway connection to a public road is allowed or the entrance and exit driveways need to connect to the public road in particular locations.

It is a further object of the invention to provide a method that allows easy storage of vehicles in such a multi tier parking garage and in particular facilitates driving into and out of the temporary parking bay for entering or getting out of a vehicle reduces the risk of damage to shoe wear.

According to a further aspect of the invention, this object is achieved by providing a parking garage according to claim 10.

Because in the filling position the filling projections substantially fill up the passages of the temporary parking wheel support, driving a vehicle into and out of the temporary parking bay does not involve driving over open passages which constitute holes in the tracks of the tires similar to pot-holes in a road. Also, the risk of a driver or passenger damaging as shoe or becoming injured, e.g. by straining an ankle, due to stepping onto or into one of such passages is avoided.

Particular elaborations and embodiments of the invention are set forth in the dependent claims.

Further features, effects and details of the invention appear from the detailed description and the drawings.

DETAILED DESCRIPTION

Figure 1:
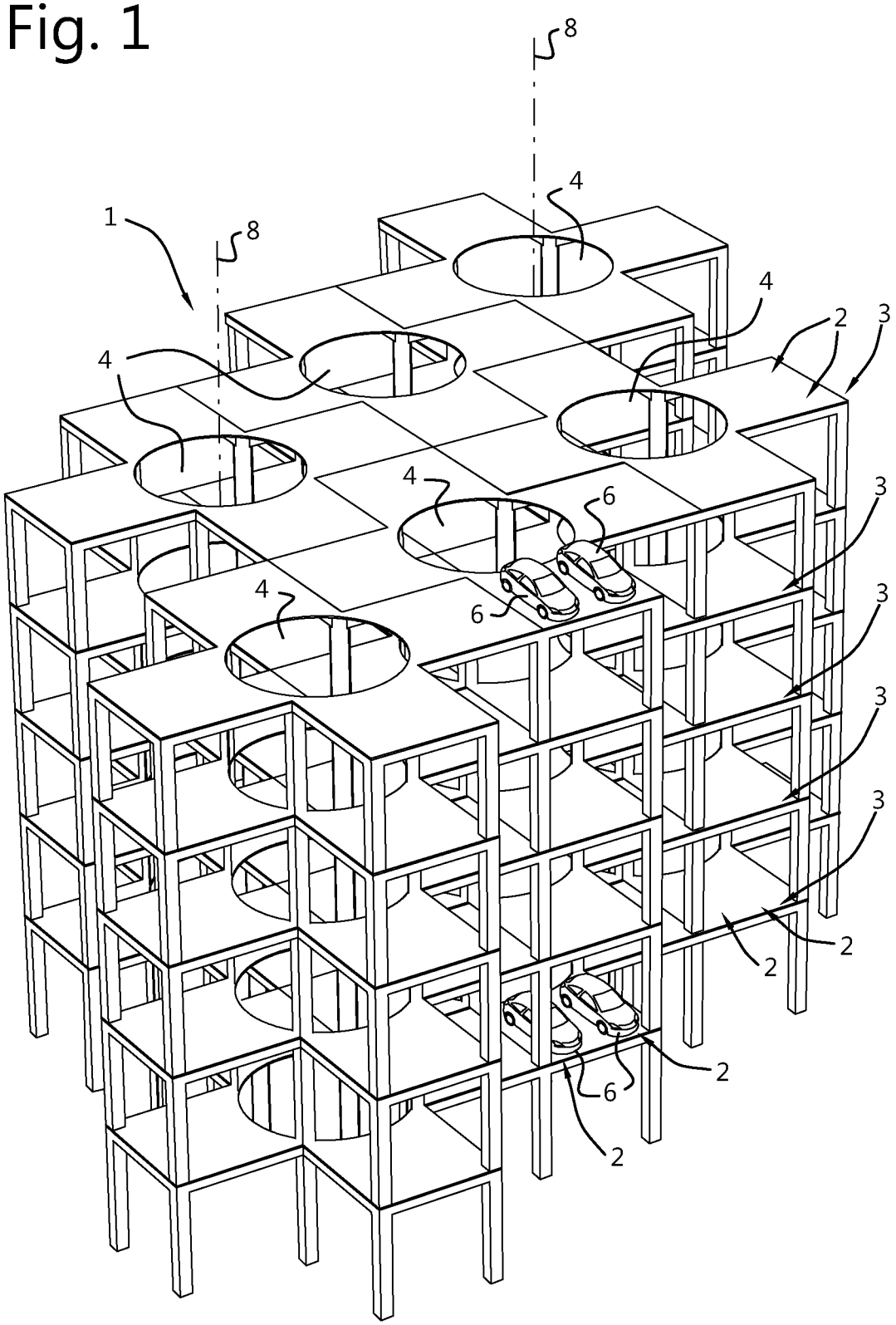
FIG. 1 is a schematic perspective view of an example of a parking garage according to the invention.
Figure 2:
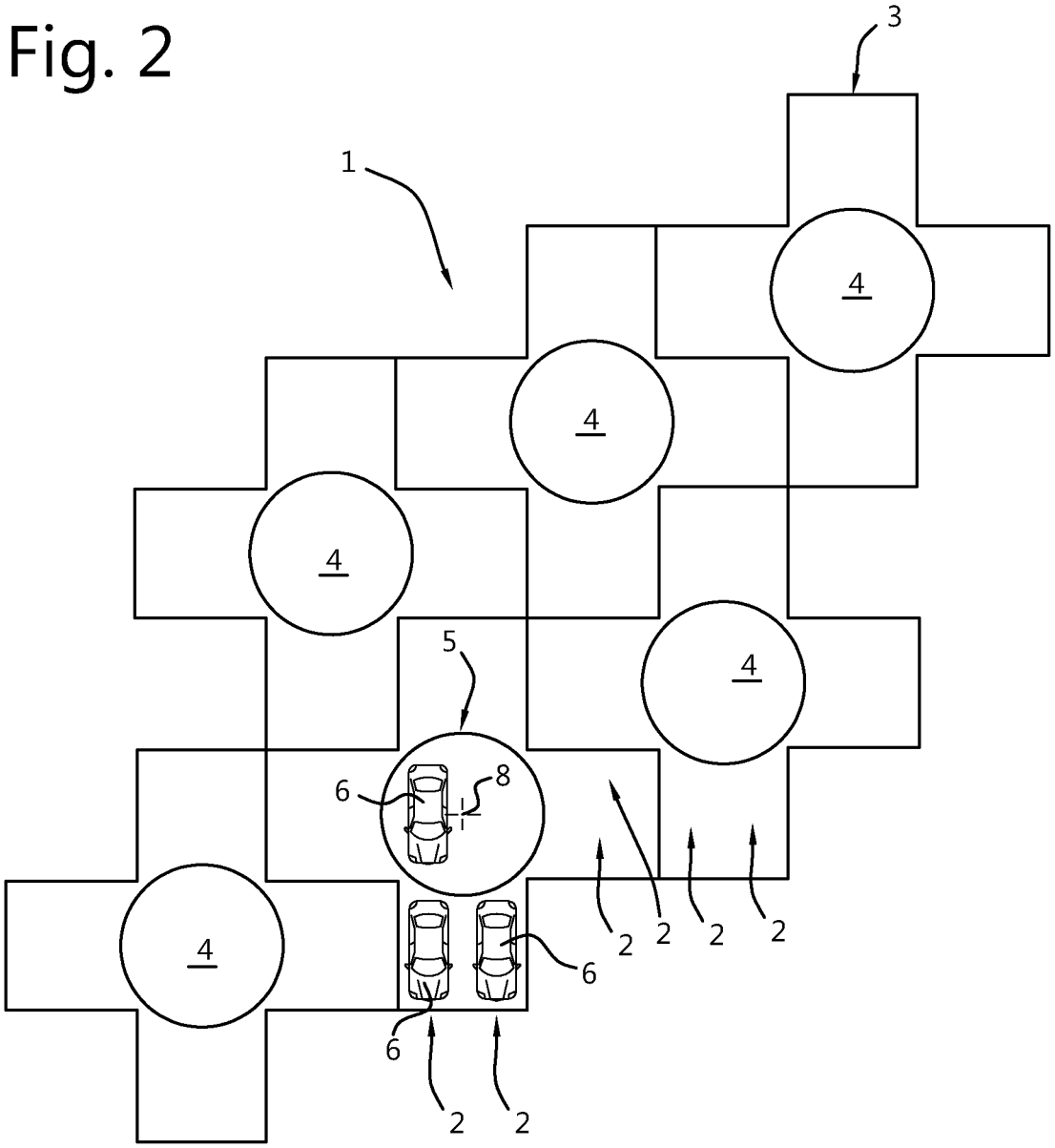
FIG. 2 is a top plan view of the parking garage shown in FIG. 1.

FIGS. 1 and 2 show a multi-tier parking garage 1 having a number of pairs of parking spaces 2 (not all designated by a reference number) each forming a floor surface area for one single parked vehicle. The parking spaces 2 are located on several tiers 3 above the ground floor. In this example, there are no parking spaces at the ground floor. However, parking spaces may also be provided on the ground floor. Elevator wells 4 are provided in each of which an elevator 5 (only one shown in FIG. 2) is displaceable vertically for delivering vehicles 6 to the required tier 3 and collecting vehicles 6 from the tiers 3. The elevator 5 has an elevator platform 7 to which supports for supporting a vehicle 6 are mounted, for holding a vehicle 6 in a vehicle lifting position laterally off-set to the side of an axis of rotation 8 of the elevator platform 7, located centrally in the elevator well, so that the vehicle 6 is aligned with two of the parking spaces 2 (one in front of the vehicle and the other one to the rear of the vehicle) when oriented parallel to these parking spaces 2. From each elevator platform 7, vehicles are displaceable to four pairs of parking spaces 2 adjacent to the respective elevator platform 7. The elevator platform 7 is rotatable so that a vehicle 6 in the vehicle lifting position on the elevator platform 7 is off-set to the side of the axis of rotation 8 of the elevator platform 7 and can be brought in any position in front of one of the parking spaces 2. It is observed that the sets of parking spaces accessible for vehicles from a common elevator may also be grouped in other configurations than the configuration shown in FIGS. 1 and 2. Moreover, it is also possible to provide that the parking spaces are arranged around a lift well in different configurations, e.g. each oriented in a different direction or groups of more than two oriented in a common direction and/or that parking spaces are accessible for vehicles from the elevator in less or more or other directions than directions oriented orthogonally relative to each other.

Depending on the desired elevator capacity, the platform 7 can be equipped for supporting one vehicle 6 off-set from the axis of rotation 8 of the elevator platform 7 or two vehicles in vehicle lifting positions side by side on opposite sides of the axis of rotation 8 of the elevator platform 7. Also when arranged for supporting only one vehicle 6, the vehicle lifting position which is off-set from the axis of rotation 8 of the elevator platform 7 to match the lateral off-set of the parking spaces 2 allows the vehicle 6 to be rotated to a position in front of any of the parking spaces 2 by rotating the elevator platform 7.

Figure 3:
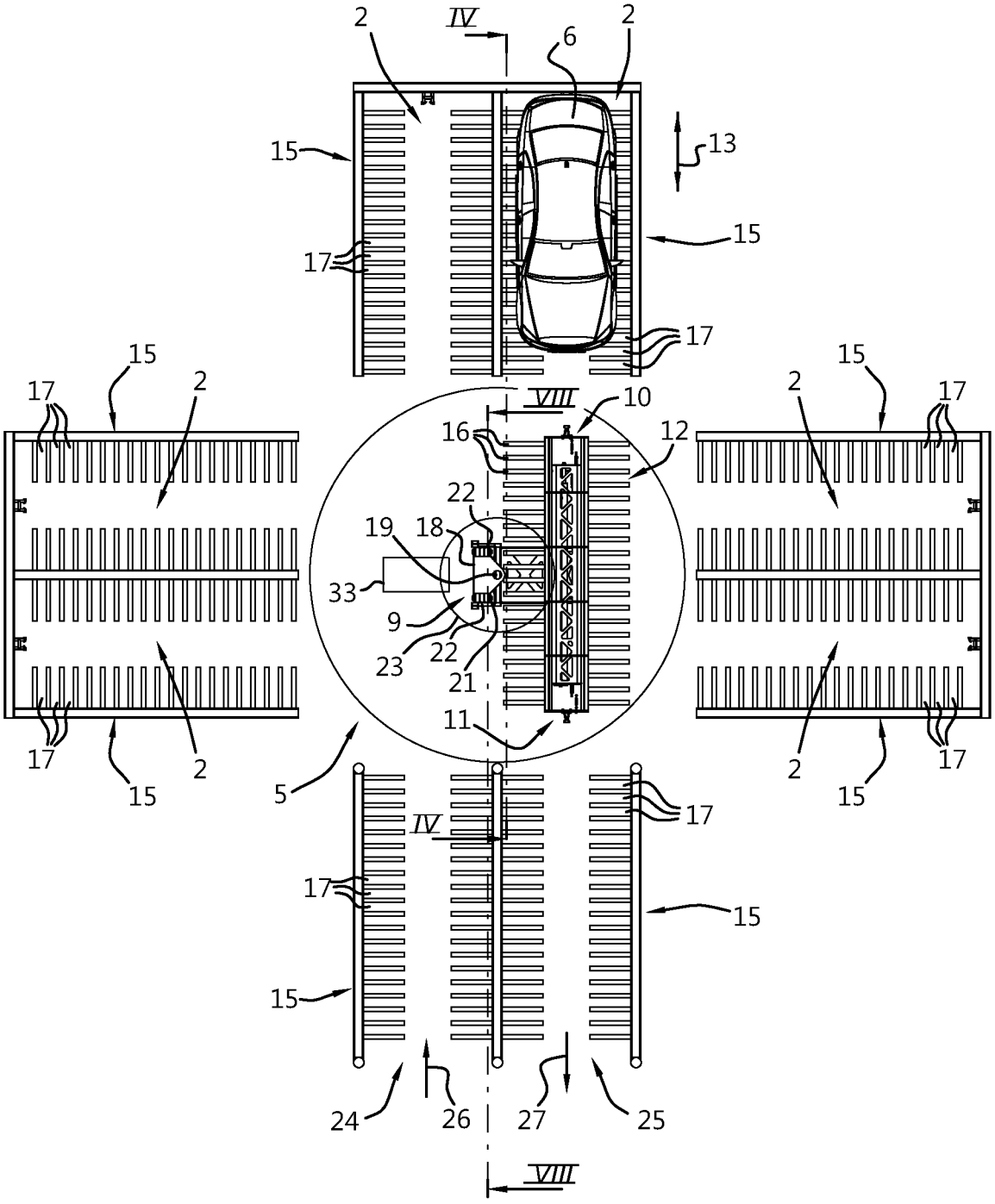
FIG. 3 is a schematic top plan view of an elevator and adjacent parking positions of the parking garage shown in FIGS. 1 and 2.
Figure 4:
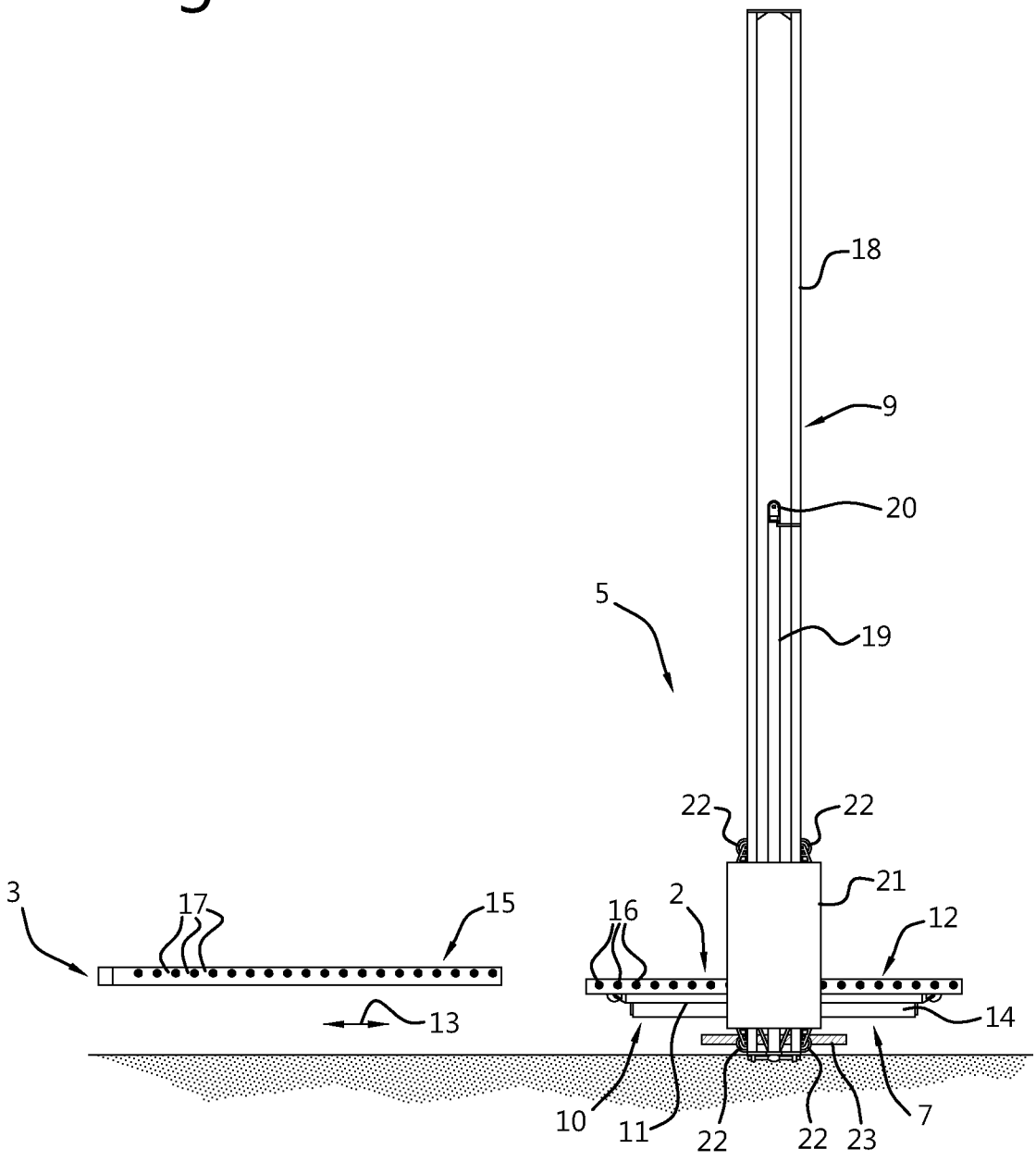
FIGS. 4-6 are schematic side views in cross-section along the line IV-IV in FIG. 3 of an elevator and an adjacent parking space in subsequent operating positions.
Figure 5:
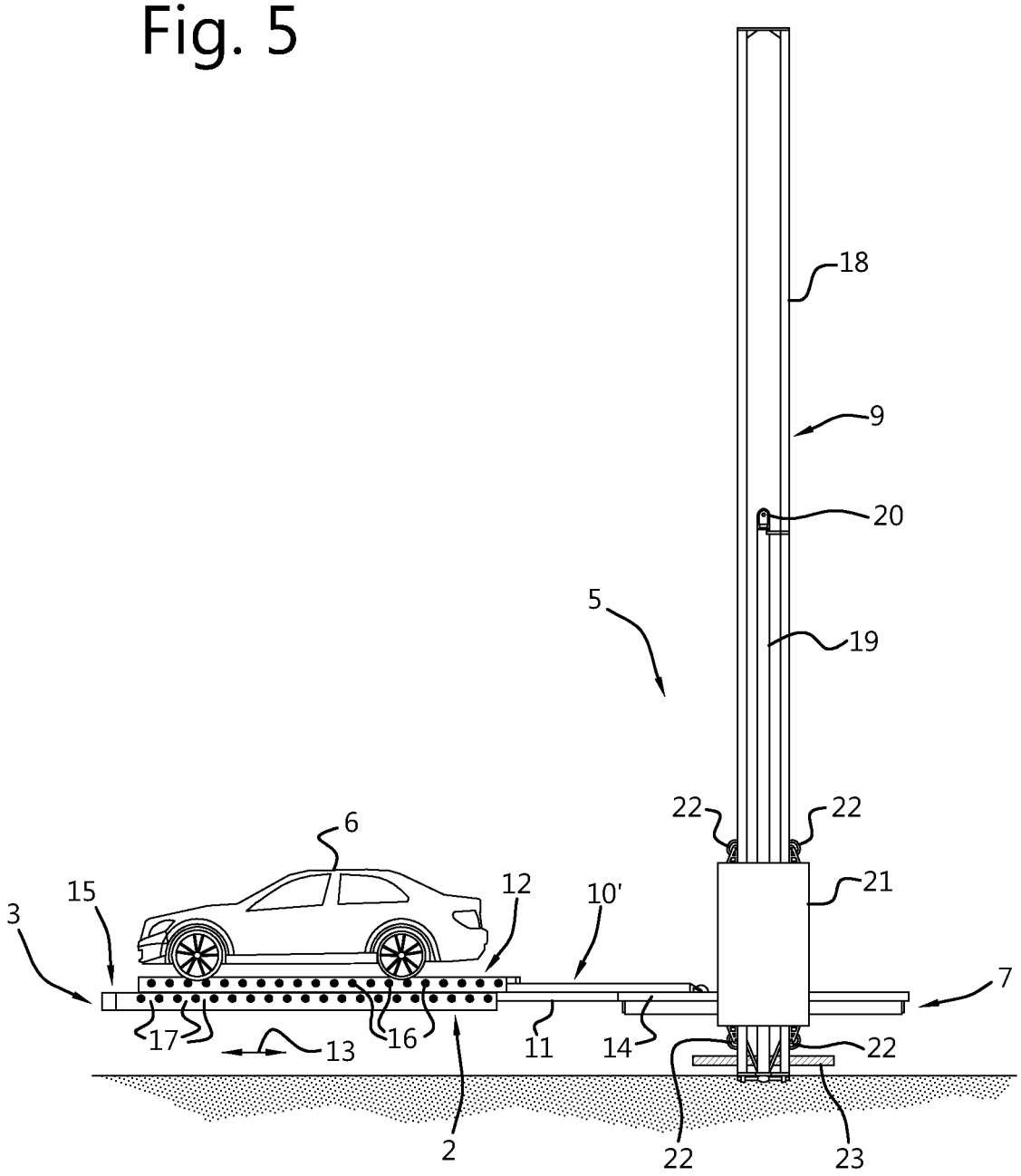
Figure 6:
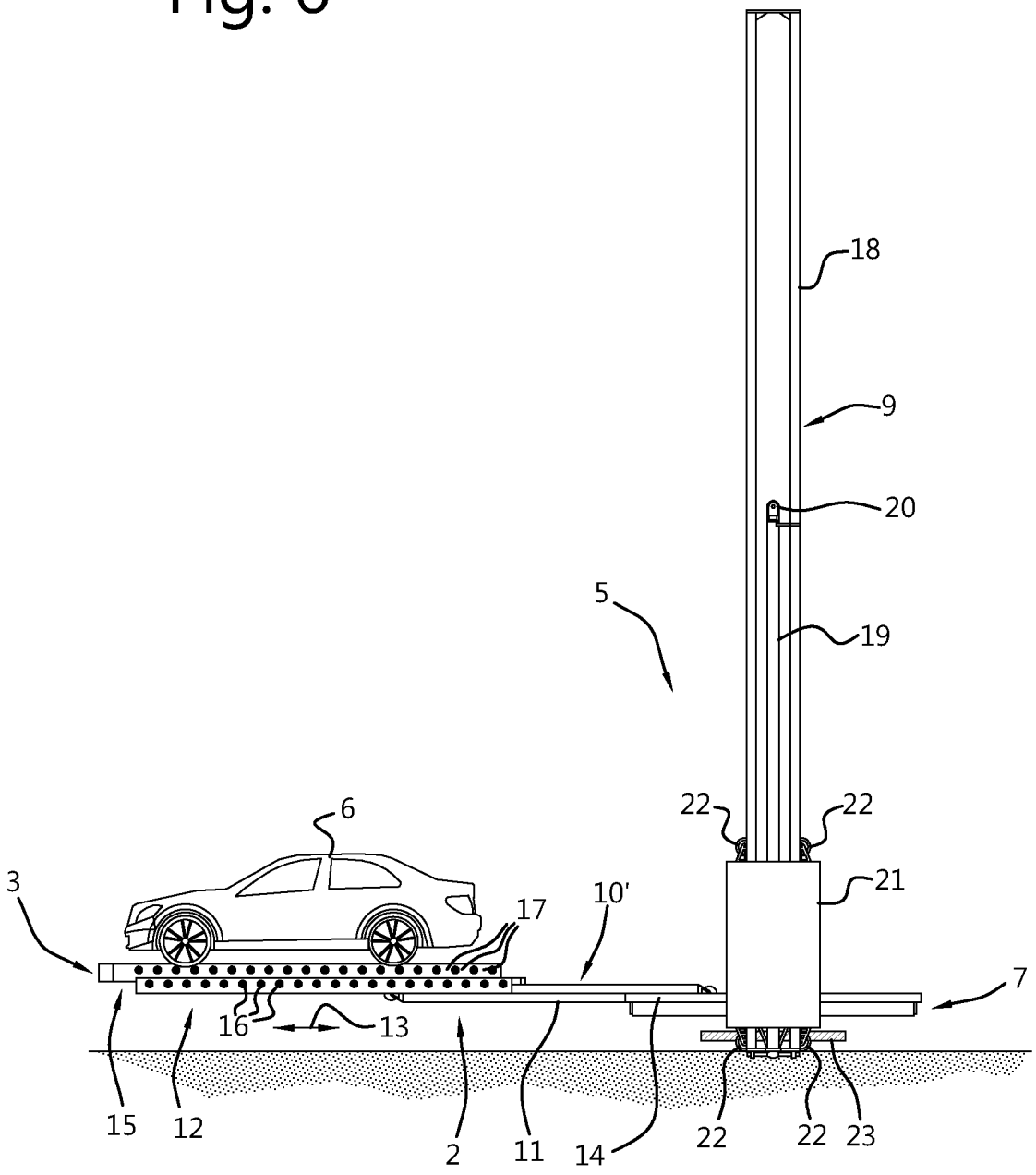

As shown in FIGS. 3-6, the elevator 5 has a lifting structure 9 arranged for moving the elevator platform 7 between at least two positions, each vertically aligned with a different one of the tiers 3 for allowing a vehicle 6 to be transferred from the elevator platform 7 to a parking space 2 of that one of the tiers 3 and from that parking space 2 to the elevator platform 7. In the present example, the lifting structure is in the form of mast 18 along which a hydraulic cylinder 19 is mounted and a cable 20 fixed near a lower end of the mast 18 and running over a pulley 20 at an upper end of the hydraulic cylinder 19. The hydraulic cylinder 19 is arranged such that the pulley 20 is movable between an uppermost position near a top end of the mast 18 and a lowermost position about half-way of the mast 18. As shown in FIGS. 4-6, when the pulley 20 is in its lowermost position, the elevator platform 7 is in its lowermost position near a lowermost end of the mast 18. When the pulley 20 is in its uppermost position, the elevator platform 7 is in its uppermost position near a top end of the mast 18. The elevator platform 7 is guided along the mast 18 by a cart 21 with wheels 22 running along the mast 18. Because the lifting structure 9 includes vertical guide 18 and the elevator platform 7 has a cart 21 running along the guide 18, the elevator platform 7 can withstand large moments in vertical and horizontal planes relative to the mast 18 without compromising operation. However, other lifting structures may be applied as well, such as a scissor lift or a hydraulic cylinder directly attached to the elevator platform.

The vertical guide 18 is pivotably suspended for allowing the rotation of the elevator platform 12 in unison with rotation of the vertical guide 18. Thus, the weight of the suspension and a drive for driving the rotation do not have to be lifted.

Rotation of the elevator platform 7 about central vertical axis 8 is driven by rotating the lifting structure by means of a drive 33 engaging a gear wheel 23 fixed to a base portion of the vertical guide 18 so as to be rotatable with the vertical guide 18 about a center line of the gear wheel 23 coaxial with the axis 8 of rotation about which the vertical guide 18 and the elevator platform 12 are rotatable. Thus, all main drives can be arranged at the foot of the elevator 5. However, it is also possible to provide that the elevator platform is rotatable relative to the lifting structure.

The elevator 5 includes a cantilever 10 movable between an extended position 10' (see FIGS. 5 and 6) extending into a position overlapping the parking space 2 for holding a vehicle 6 in a parking position above the parking space 2 and a retracted position 10 (see FIGS. 3 and 4) for holding a vehicle 6 in a vehicle lifting position above the elevator platform 7. Thus, the mechanized means for the displacement of vehicles 6 between the elevator 5 and the parking spaces 2 are part of the elevator structure 5 which facilitates installation and can be powered from the elevator structure 5. This reduces complexity and the number of separate items to be installed into the parking garage 1. The integration of the mechanized means for the displacement of vehicles between the elevator and the parking spaces in the elevator structure also facilitates the addition of further tiers to an existing parking garage.

In this example, the cantilever 10 consists of two cantilever members 11, 12 that are guided relative to each other and the elevator platform 7 for movement in displacement directions 13, so that a vehicles 6 can be brought to and collected from two opposite pairs of parking spaces 2 horizontally at tier 3 with the elevator platform 7 in the same orientation about the vertical axis 8. The first cantilever member 11 is an intermediate member guided for horizontal movement only relative to the elevator platform 7 by a first guide 14, while the second cantilever member 12 is guided for horizontal movement only relative to the first cantilever member 11. The guides preferably include ball or roller bearings. For driving displacement of the cantilever members, preferably hydraulic cylinders are mounted between the second cantilever member and the first cantilever member and between the first cantilever member and the elevator platform. However, other dive means, such as a rack and pinion drive or a linear motor or a cylinder combined with a cable drive converting movement of one of the cantilever members into a corresponding movement of the other cantilever member may also be applied.

In this example, the second cantilever member 12 also constitutes an elevator wheel support for supporting the supported vehicle via its wheels. The parking spaces 2 each have parking wheel supports 15 for supporting the supported vehicle 6 via its wheels. The lifting structure 9 is arranged for moving the elevator platform 7 near each of the tiers 3 between a vehicle carrying level (see FIGS. 4 and 5) and a non vehicle carrying level (see FIG. 6) below the vehicle carrying level.

As is illustrated by FIGS. 3-6, the elevator wheel supports 12 and the parking wheel supports 15 are arranged for allowing the cantilever 10 to move from its retracted position 10 to its extended position 10' shown in FIG. 5 in which the elevator wheel support 12 supports wheels of the vehicle 6 in positions above and free from the parking wheel supports 15, while the elevator platform 7 is at the vehicle carrying level near the tier 3.

The elevator wheel supports 12 and the parking wheel supports 15 are further arranged for allowing the elevator wheel supports 12 to subsequently move downwardly until the wheels of the vehicle 6 are supported by the parking wheel supports 15 and the elevator wheel supports 12 are free from the wheels of the vehicle 6 supported by the parking wheel support 15, while the elevator platform 7 descends from the vehicle carrying level to the non vehicle carrying level near the same tier 3, as is illustrated by the displacement of the cantilever 10 from the position shown in FIG. 5 to the position shown in FIG. 6 relative to the stationary mounted parking wheel supports 15.

With the elevator platform 7 at the non vehicle carrying level (FIG. 6), the cantilever 10 can be moved back from its extended position 10' to its retracted position 10 as shown in FIG. 4, but at the lowered position as shown in FIG. 6. The described displacements can also be carried out in opposite direction and order for collecting a vehicle supported by one of the parking wheel supports 15.

Thus, a simple vertical movement of the elevator wheel support 12 is sufficient for transfer of a vehicle from the elevator wheel support 12 to the parking wheel support 15 or back and the extendable cantilever 10 allows the vehicle to be displaced horizontally between positions on one of the parking wheel supports 15 and a position on top of the elevator platform 7, with all the functionality integrated in the elevator assembly and no need for installing driven moving parts in the parking spaces 2.

In the present example, the elevator wheel supports 12 and the parking wheel supports 15 are arranged for allowing the elevator wheel support 12 to pass underneath the parking wheel supports 15 if the elevator platform 7 is at the lower, non vehicle carrying level and while the cantilever 10 moves from its extended position 10' to its retracted position 10. Thus, the elevator wheel support 12 can be of a simple fixed design. However, if the elevator wheel support has for example retractable or collapsible parts, the elevator wheel support does not need to be capable of passing underneath the parking wheel supports.

Furthermore, in the present example, the elevator wheel supports 12 have support fingers 16 (not all designated by a reference number) having free ends and projecting in directions transverse to the horizontal directions 13 in which the cantilever 10 is movable between the extended and retracted positions. The parking wheel supports 15 have passages 17 (not all designated by a reference number) having open ends. The fingers 16 and the passages 17 are arranged for allowing most of the fingers 16 to each pass through one of the passages 17 while the elevator platform 7 moves between the vehicle carrying level and the non vehicle carrying level as can be seen in FIGS. 5 and 6. Thus, the fingers 16 supporting wheels of a vehicle 6 can easily pass downwards through the passages 17 of the parking wheels support 15 for releasing from the wheels of the vehicle 6 and leaving the vehicle 6 supported by the parking wheels support 15. Passing the fingers 16 each upwards through one of the passages 17 allows the vehicle to be picked up from the parking wheel support 15. Preferably, the passages 17 in between the fingers of the parking wheel supports 15 for supporting wheels of a vehicle are small, e.g. less than one third or a quarter of the width of the fingers of the parking wheel supports 15 and/or less than 4, 3 or 2 cm, and preferably these fingers have generally flat upward facing surfaces, so that the tires of the vehicles are not subjected to high local pressure over a prolonged period of parking time. The lifting structure 9 is arranged for driving displacement of the elevator platform 7 near each of the tiers 3 between the vehicle carrying level and the non-vehicle carrying level. Thus, the vertical displacement of the elevator wheel support 12 relative to the parking wheel support 15 for transferring a vehicle to one of the parking wheel supports 15 or for picking up a vehicle from one of the parking wheel supports 15 can be driven by the same lifting structure 9 that also drives displacement of the elevator platform from one tier to the other and/or to the ground floor.

Since the cantilever 10 is extendable from the elevator platform 7 in mutually opposite directions 13, a vehicle supported by any of the elevator wheel supports 12 can be transferred to any of the parking spaces 2 and if transport capacity of an elevator having only one of the cantilevers 10 is sufficient, the elevator 5 may be equipped with a single cantilever 10 with a single elevator wheel support 12 only, while maintaining the capability of delivering to and collecting from all of the parking spaces 2.

It is noted that a car to be parked can for instance be driven into an entry position 24 (see FIG. 3) on an entrance pathway as schematically designated by arrow 26. The entry position 24 may be equipped with wheel supports 15 identical to the parking wheel supports 15. A car can simply be driven into the entry position 24 forward in its normal driving direction, which facilitates dropping off of the car to be parked. The driver and any passengers then leaves or respectively leave the car so that the area of the parking garage where the cars are parked does not have to be accessible to the public and does not have to meet safety requirements applicable to areas accessible to the general public. The vehicle to be parked is then picked up from the entry position 24 in the same manner as it is picked up from a parking space 2, transferred onto the elevator platform 7 and transferred from the elevator platform 7 to an available parking space 2 at the same level or at the level of another tier 3.

As is shown in FIG. 3, the parking garage 1 also has an exit path 27 starting from a vehicle collecting position 25, where a driver and any passengers can enter the vehicle retrieved from the parking garage. The vehicle lifting position and the parking spaces 2 are arranged for supporting a vehicle on the elevator platform 7 in line with each of the parking spaces 2. For some of the parking spaces 2, the elevator platform 7 needs to be in a first position to bring the vehicle lifting position in line with that parking space 2. For other ones of the parking spaces 2, the elevator platform 7 needs to be in a second position rotated relative to the first position about the vertical line 8 about which the elevator platform 7 is rotatable, to bring the vehicle lifting position in line with that parking space 2.

The vehicle lifting position and the entrance and exit paths 26, 27 are arranged for allowing supporting a vehicle on the elevator platform 7 in line with the entrance path 26, a first end of the vehicle lifting position in the driving direction facing the entrance path 26 when the elevator platform 7 is in an entry position and for allowing supporting a vehicle in line with the exit path 27, the same first end of the vehicle lifting position in the driving direction facing the exit path 27, when the elevator platform 27 is in an exit position rotated relative to the entry position.

Thus, a vehicle may be transferred from the entrance path 26 to the vehicle lifting position in a forward direction; and transferred from the vehicle lifting position to a parking space 2 in a forward or rearward direction. When a vehicle is collected from the parking garage, its may be transferred from its parking space 2 to the vehicle lifting position in a rearward or, respectively, forward direction; and regardless of the direction in which it was transferred from the parking space 2, be transferred from the vehicle lifting position to the collecting position 25 in the exit path 27 in the forward direction.

Thus, regardless of the direction in which the entry and exit paths connect to the elevator well, users can always drive vehicles to a drop off point 24 in the entry path 26 in a forward direction and drive away from a collection point 25 in the exit path 27 in a forward direction as well. In particular, as shown in the present example, a combined driveway (e.g. with an entry lane and an exit lane or a single lane for a small garage) may be provided via which the parking garage can be entered and exited. Thus, the entrance and exit require little ground surface area and can conveniently be accommodated to city planning constraints, for instance if only a single combined driveway connection to a public road is allowed or if the entrance and exit driveways need to connect to the public road in particular locations.

For a compact, efficient configuration, it is advantageous if, as in the present example the elevator platform 7 is rotatable from a first position with the vehicle lifting position in line with some of the parking spaces 2 to a second position with the vehicle lifting position in line with other ones of the parking spaces 2 over a half turn (180°) about the vertical line 8 of the elevator platform 7 and that the elevator platform is rotatable from the entry position to the exit position over a half turn about the vertical line 8 of the elevator platform 7 as well.

In this example, the parking spaces 2 are arranged pairwise in side by side positions. These pairs of parking spaces are circumferentially distributed around the elevator well 4. The elevator platform 7 is rotatable about the vertical axis 8 from a first position for bringing the vehicle lifting position in line with a left one of the parking spaces 2 of a pair of the parking spaces 2 to a second position for bringing the vehicle lifting position in line with a right one of the parking spaces 2 of the respective pair over a half turn.

Figure 7:
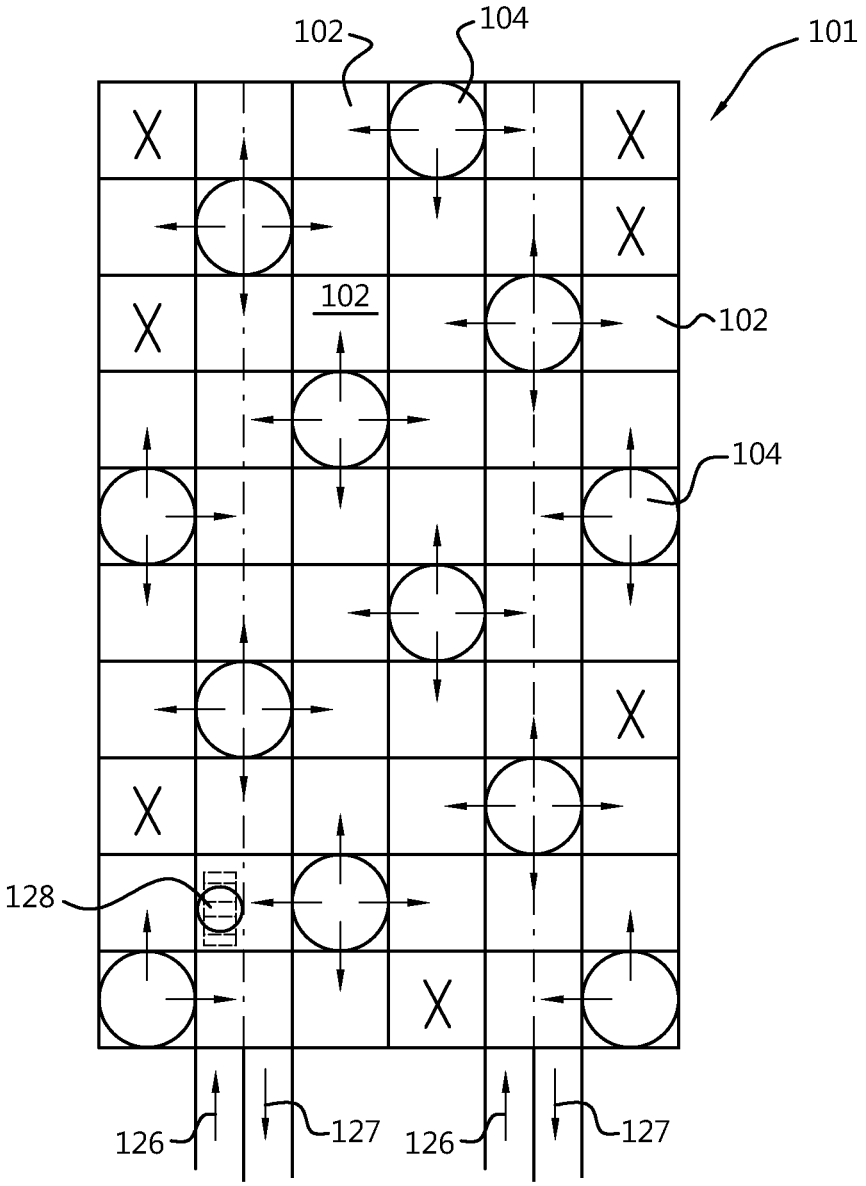
FIG. 7 is a schematic top plan view of a further example of a parking garage according to the invention.

In FIG. 7, an alternative example of a parking garage 101 according to the invention is shown. In this example, a cart 128 is provided on which cars to be parked or collected can be transferred from an entry to an elevator well 104 or from an elevator well 104 to an exit. This allows a parking garage to be of a larger horizontal size and to have a plurality of elevators, while users can still drop off and collect cars a limited number of positions. The cart 128 has a chassis that allows the cart to turn about a vertical axis, while otherwise stationary. Thus, vehicles can also be transported to elevators that are not directly adjacent straight entry and exit paths 126, 127. Transfer of vehicles to and from all of the parking spaces 102 can be performed by the respective adjacent elevators.

Figure 8:
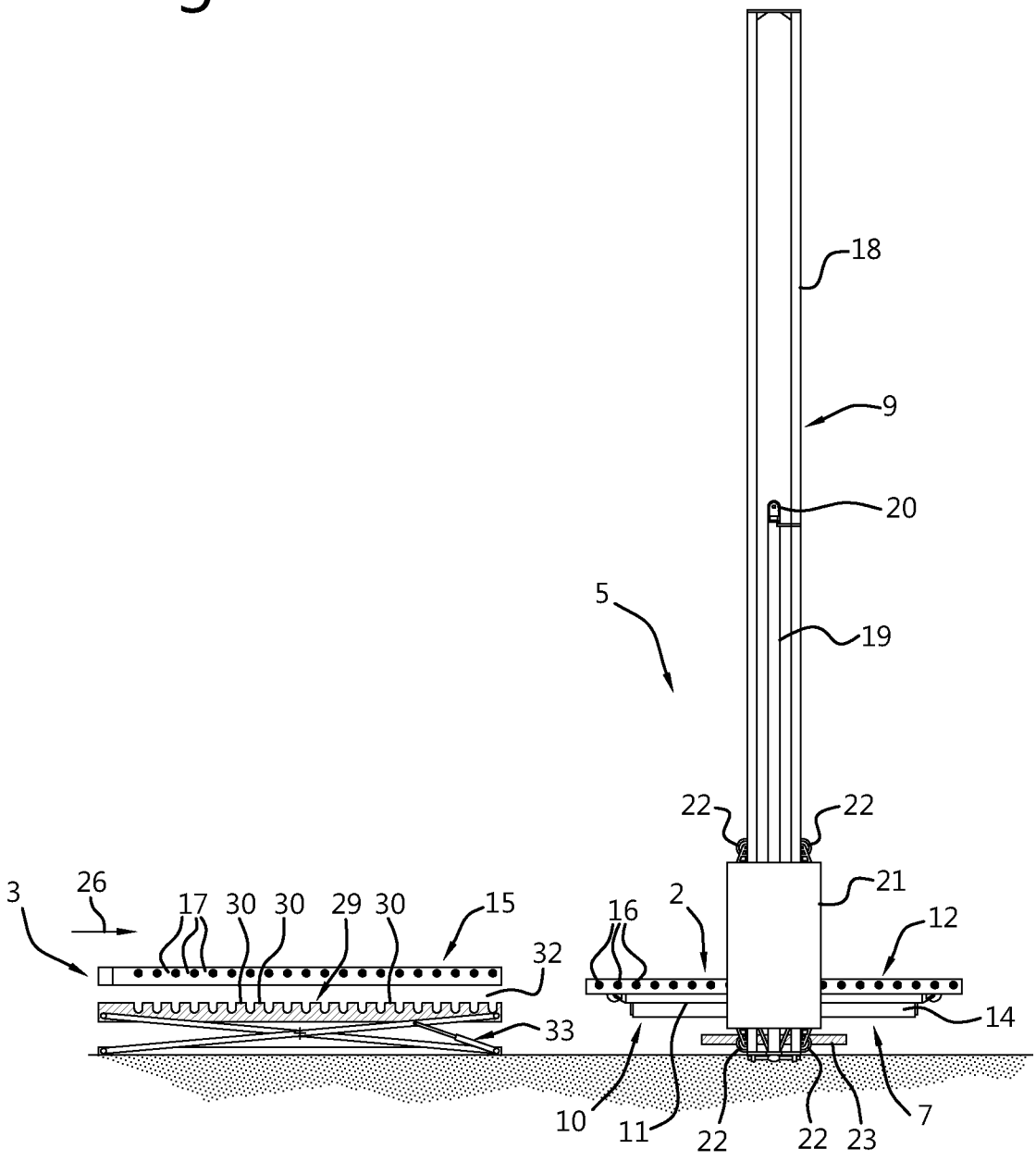
FIG. 8 is a schematic side view in cross-section along the line VIII-VIII in FIG. 3.

In FIG. 8, one of the parking wheel supports 15 that constitutes a temporary parking wheel support in line with the entry path 26 is shown. The parking wheel support that constitutes a temporary parking wheel support in line with the exit path 27 is preferably of the same construction. The parking garage is further provided with a filling member 29 having filling projections 30 (not all designated by a reference numeral) dimensioned and arranged with mutual spacings allowing the filling projections 30 to project into the passages 17 of the temporary parking wheel support 15. The filling member 29 is movable between a first filling position in which the filling projections 30 project into the passages 17 of the temporary parking wheel support 15 and having topmost surfaces substantially at a common level with an upper surface of the surfaces between the passages 17 of the temporary parking wheel support 15 and a retracted position (shown in FIG. 8) leaving a space 32 under the temporary parking wheel support 15 free for allowing the fingers 16 of the elevator wheel support 12 to pass horizontally underneath the temporary parking wheel support 15 towards and away from the passages 17.

In this example, the movability of the temporary parking wheel support 15 is in a vertical direction, the temporary parking wheel support 15 being supported by a scissor lift 33. However, for vertical movement, also other types of lifts may be provided and for clearing the space 32 under the temporary parking wheel support 15, the filling member 29 may also be moved in a vertical direction.

Although certain presently preferred embodiments of the present invention have been specifically described herein, it will be apparent to those skilled in the art to which the invention pertains that variations and modifications of the various embodiments shown and described herein may be made without departing from the spirit and scope of the invention.

Accordingly, it is intended that the invention be limited only to the extent required by the appended claims and the applicable rules of law. Several features have been described as part of the same or separate embodiments. However, it will be appreciated that the scope of the invention also includes embodiments having combinations of all or some of these features other than the specific combinations of features embodied in the examples.

The invention claimed is:

1. A multi-tier parking garage for vehicles, comprising:

at least one tier, the at least one tier including a parking space for a vehicle; and an elevator having an elevator platform for supporting the vehicle and a lifting structure, the lifting structure being arranged for moving the elevator platform between at least two positions, wherein at least one of said at least two positions is vertically aligned with the at least one tier for allowing the vehicle to be transferred from the elevator platform to the parking space of said at least one tier and from said parking space to said elevator platform;

wherein the elevator includes a cantilever movable between an extended position extending into a position overlapping the parking space for holding a vehicle in a parking position above the parking space and a retracted position for holding a vehicle in a vehicle lifting position above the elevator platform, wherein the elevator platform has elevator wheel supports for supporting the vehicle via wheels of the vehicle;

wherein the parking space has parking wheel supports for supporting the vehicle via wheels of the vehicle;

wherein the lifting structure is arranged for moving the elevator platform near said at least one tier between a vehicle carrying level and a non vehicle carrying level below said vehicle carrying level; and wherein the elevator wheel supports and the parking wheel supports are arranged for allowing:

with the elevator platform at said vehicle carrying level, said cantilever to move from said retracted position to said extended position in which the elevator wheel supports are above and free from the parking wheel supports, while the elevator platform descends from said vehicle carrying level to said non vehicle carrying level, the elevator wheel supports to subsequently move downwardly until the wheels of the vehicle are supported by the parking wheel supports and the elevator wheel supports are free from the wheels of the vehicle, and with the elevator platform at said non vehicle carrying level, said cantilever to move from said extended position to said retracted position, wherein the elevator wheel supports and the parking wheel supports are arranged for allowing, with the elevator platform at said non vehicle carrying level while said cantilever moves from said extended position to said retracted position, the elevator wheel supports to pass underneath said parking wheel supports, wherein the elevator wheel supports comprise support fingers having free ends and projecting in directions transverse to directions in which said cantilever is movable between said extended and retracted positions, wherein said parking wheel supports have passages having open ends, and wherein said support fingers and passages are arranged for allowing said support fingers to pass through said passages while the elevator platform moves between said vehicle carrying level and said non vehicle carrying level, and wherein at least one of said parking wheel supports constitutes a temporary parking wheel support in line with an entry or exit path and further comprising a filling member having filling projections dimensioned and arranged at mutual spacings allowing the filling projections to project into said passages of said temporary parking wheel support, said filling member being movable between a filling position in which said filling projections project into said passages of said temporary parking wheel support and having topmost surfaces substantially at a common level with an upper surface of said temporary parking wheel support and a spaced-apart position leaving a space under said temporary parking wheel support free for allowing said support fingers of said elevator wheel support to pass horizontally underneath said temporary parking wheel support towards and away from said passages.

2. The parking garage according to claim 1, wherein the lifting structure is arranged for driving displacement of the elevator platform near said at least one tier between the vehicle carrying level and the non vehicle carrying level.

* * * * *